United States Patent [19]

Bierlich

[11] 4,069,548

[45] Jan. 24, 1978

[54] HINGE FOR USE WITH WINDOW ASSEMBLY

[76] Inventor: Johannes Harald Bierlich, Oresundshoj 15, Charlottenlund, Denmark

[21] Appl. No.: 703,296

[22] Filed: July 7, 1976

[51] Int. Cl.[2] ..... E05D 11/08

[52] U.S. Cl. ..... 16/140

[58] Field of Search ..... 16/128 R, 136, 139, 16/140, 141, 142, 152, 178, 179

[56] References Cited

U.S. PATENT DOCUMENTS

| | | | |
|---|---|---|---|
| 2,645,811 | 7/1953 | Sarenholm | 16/140 |
| 2,948,916 | 8/1960 | Lewin | 16/140 |
| 3,979,791 | 9/1976 | Collin | 16/135 |

*Primary Examiner*—G. V. Larkin

*Attorney, Agent, or Firm*—Brisebois & Kruger

[57] ABSTRACT

A hinge for use in a horizontally pivoted window assembly comprises a pivot member cooperable with an eye member and means responsive to the weight of a window acting on either of said members to increase the friction therebetween after an initial opening movement of the hinge.

10 Claims, 6 Drawing Figures

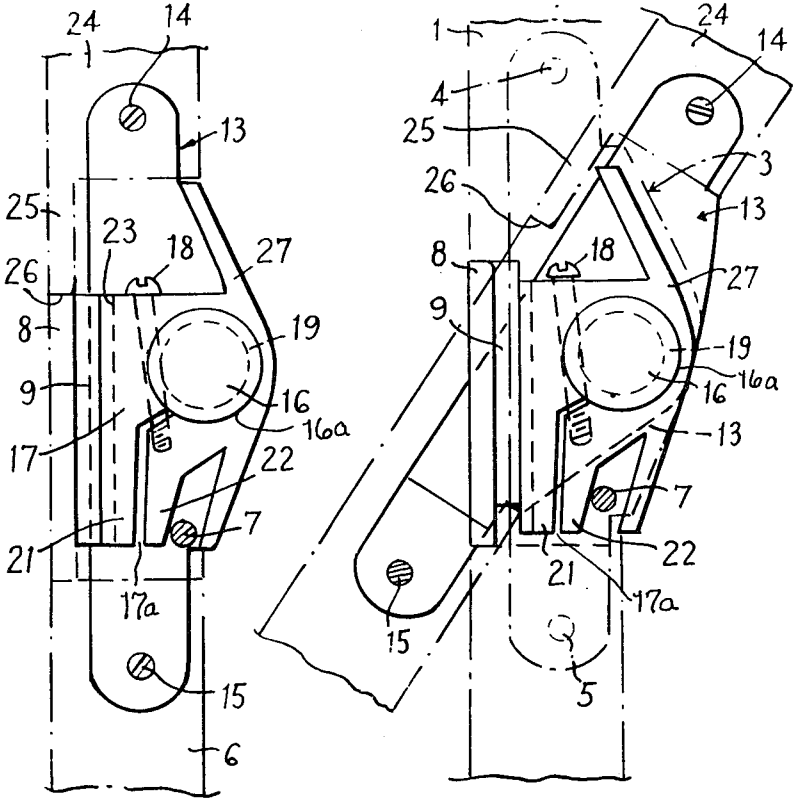
Fig.3
Fig.2
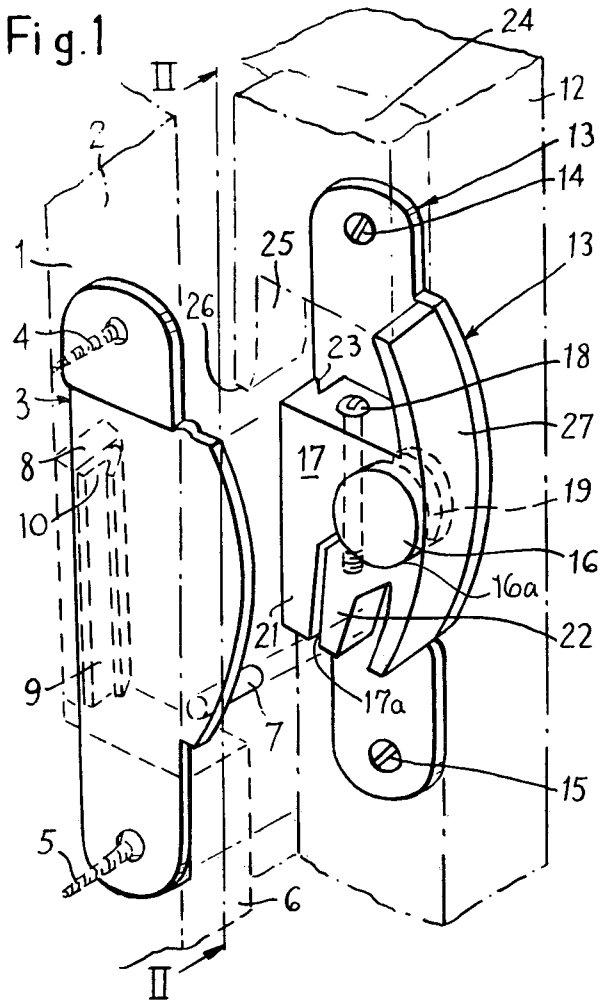
Fig.1

HINGE FOR USE WITH WINDOW ASSEMBLY

This invention relates to a hinge arrangement for use with window assemblies which are pivoted about a horizontal axis substantially midway along the stiles of a window sash and to window assemblies for use with such a hinge arrangement.

It is desirable to provide such pivoted windows with some means for restricting the ease with which they can be rotated so that they are less likely to be moved in an unwanted manner, for example by gusts of wind.

According to one aspect of the present invention there is provided, for use with a horizontally pivoted window assembly, a hinge having a pivot member, an eye member cooperable with the pivot member, the friction between the eye member and the pivot being adjustable, the pivot member being attachable to one of either the stile of a window sash or the jamb of a window surround and the eye member being attachable to the other of either the stile of the sash or the jamb of the surround, and the arrangement being such that the weight of the window sash acts to increase the friction between the eye member and the pivot.

According to another aspect of the invention there is provided a window assembly having a pair of the above defined hinges.

One feature of the invention is the provision of an arrangement which enables the friction between the pivot and the eye member to be less during the initial opening and final closing movements of the sash than during its remaining movement.

Embodiments of the invention will now be described with reference to the accompanying drawings in which:

FIG. 1 is an exploded perspective view of a hinge arrangement,

FIGS. 2 and 3 are side elevations viewed in the direction of the arrows from the line II—II of FIG. 1 in respective different operative positions.

Figure 4:
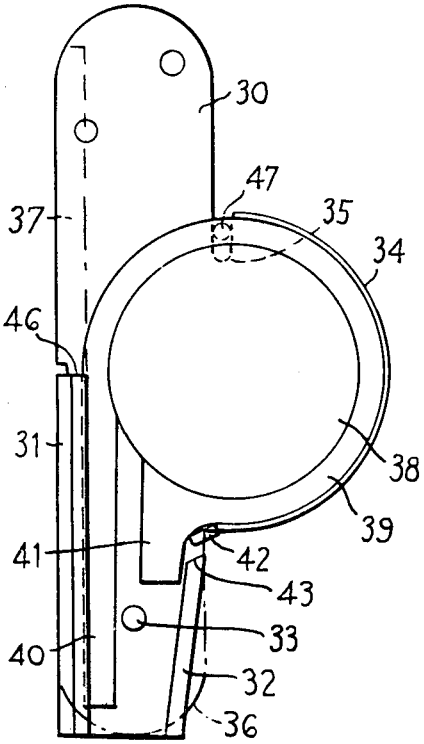
FIGS. 4 and 5 are similar side elevations of a further hinge arrangement in different respective operative positions and FIG. 6 is an underneath plan view of the arrangement of FIG. 4.

Referring to FIGS. 1 to 3, a partly cut-away jamb 1 of a window surround (fixed window frame), which is indicated by dotted lines has a recessed portion 2 in which there is situated a mounting plate 3 which is screwed, by means of screws 4 and 5 also indicated by dotted lines, to the cut-away part of the jamb, which is not shown. The lower part of the plate 3 is covered by a wooden cover moulding 6. The plate 3 carries a pin 7 and an angled portion 8 of the plate 3 carries a member 9 bent to provide a groove or channel 10.

A stile 12 (upright side of the movable window) of a window sash has a pivot member comprising a plate 13 mounted thereon by means of screws 14 and 15 and a pivot 16 extends from the plate 13 to form a support for an eye member 17 through which it passes and which is held on to the pivot 16 by means of a screw 18 co-operating with a groove 19 in the pivot 16. The eye member 17 which is normally freely rotatable upon the pivot 16 has a slot extending from its edge to its eye through which the pivot 16 passes, thereby forming two finger elements 21 and 22. The eye member 17 is grooved near to its rear or outwardly facing edge to form a lip 23 which co-operates with the groove 10 formed by the member 9 mounted on the angled portion 8 of the plate 3. A moulding 24, which covers the upper part of the plate 13 and the screw 14, has a tongue 25 with an end surface 26 which is co-operable with the upper end of the angled part 8 of the plate 3. The eye member 17 includes a part 27 which forms a cover plate for the assembly as viewed from the inside of the window.

Of course a similar co-operating hinge arrangement is provided between the other stile of the sash and the other jamb of the surround.

It will be seen, more clearly from FIG. 2, that in order to assemble the parts of the hinge attached to the respective plates 3 and 13, the lip 23 is slid downwards in the groove 10 formed by the member 9 mounted on the angled part 8 of the plate 3. When the parts are assembled together in the way described, and with the window sash in the closed position as may be seen from FIG. 2, the finger 22 does not press upon the pin 7 with the window sash in the open position, as may be seen from FIG. 3, and under the influence of the weight of the window sash, the finger 22 is pressed down on to the pin 7, thereby causing a force to be exerted which presses the finger 22 towards the finger 21 and the eye member 17, which in the particular embodiment is made of brass, to be tightened upon the pivot 16, which is made of steel, thereby providing a good friction grip between the eye member 17, and thus the jamb 1, and the pivot 16, and thus the stile 12.

The position of the end surface 26 of the tongue 25, in relation to the end of the angled part 8 of the plate 3, is such that when the window sash is rotated about the eye member towards the position shown in FIG. 2, the surface 26 abuts against that of the end of the member 8 to form a pivot point shortly before the position shown in FIG. 2 is reached, thereby causing the eye member 17 to be raised and the finger 22 to be taken out of engagement with the pin 7. The raising of the eye member with respect to the pin 7 in this way releases the friction grip of the eye member upon the pivot 16 and enables the final closing rotation of the sash to the position shown in FIG. 2 to be made with reduced friction between the pivot 16 and the eye member 17.

Similarly, in opening the window sash from the position shown in FIG. 2 to that shown in FIG. 3 the friction between the pivot 16 and the eye member 17 during the initial rotation of the sash will be less than that which is experienced after the point is reached at which the eye member falls under the influence of the weight of the window sash to the position shown in FIG. 3 in which the pin 7 presses the finger 22 towards the finger 21 and increases the friction between the pivot 16 and the eye member 17. The parts are so dimensioned that this increase in friction occurs at a position in which the window sash is opened to a predetermined minimum extent and is such that even though the window sash can be opened to this initial position with comparative ease, for example even by a child, it would not be possible for a child either to move the window further with ease or to fall through the opening which results from opening the window to this initial position.

The arrangement has the advantage that it is self compensating against wear between the eye member and the pivot 16. The compensating effect is provided by the pin 7 acting upon the finger 22 at a higher position automatically as wear occurs between the pivot 16 and the eye member 17. The cover plate 27 is so designed that it hides the mechanism from view during both the open and closed positions of the window. In the particular embodiment described the eye member 17 is made of brass and the remaining parts are made of mild steel although other suitable materials can be used.

Figure 5:
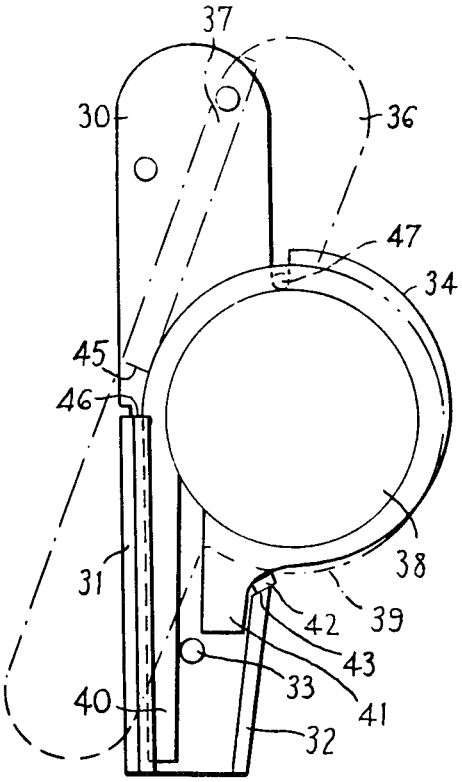
Figure 6:
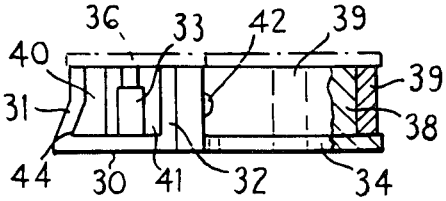

Referring to FIGS. 4, 5 and 6, there is shown a plate 30 having angled parts 31 and 32 and a pin 33 and suitable for mounting on the jamb of a window surround. A part 34 of the flat plate 30 has a semi-circular shape and a groove 35 is provided in the plate.

A pivot member comprising a second plate 36 for mounting on the stile of a window sash has an angled part 37 and a roughly semicircular flat part corresponding to the part 34 of the plate 30. The plate 36 carries a pivot 38. A resilient eye member 39, having finger portions 40 and 41, is located and freely rotatable on the pivot 38 by means not shown. A hardened insert member 42 is inset into the comparatively soft metal of the eye member 39, which in the particular embodiment is made of brass and the member 42 co-operates with the end surface 43 of the angled part 32. The finger 40 is shaped to co-operate slidably with the angle 44 formed between the part 31 and the plate 30 in order to hold the plates 30 and 36 and their associated parts together. The angled part 37 has an end face 45 which co-operates with an end face 46 of the angled part 31 of the plate 30. The pin 47 mounted on and extending from the eye member 39 locates, when the parts are assembled, in the groove 35 of the plate 30.

The parts are assembled by sliding the finger 40 into the angle 44 until the position shown in FIG. 5 is reached. In this position the pin 47 is located at the bottom of the groove 35 and the insert 42 in abutment with the end face 43 of the angled part 32. The pin 33 assists in locating the finger 40 and, with the weight of the sash on the plate 36, the reaction between the insert 42 and the end face 43 of the angled part 42 is such that the finger 41 is urged towards the finger 40 by the reaction between the insert 42 and the end face 43 of the angled part 32. This action causes the eye member 39 to increase its grip upon the pivot 38 and to provide a friction loading upon the movement of the window sash about the pivot. In closing the window sash the end face 45 of the angled part 37 is brought into abutment with the end face 46 of the angled part 31 as the window nears the closed position and the pivot 38 and the eye member 39 are raised, relative to the plate 30, about the pivot points provided by the end faces 45 and 46 in such a way that the insert 42 is taken out of engagement with the end face 43 and the pin 47 is raised in the groove 35.

As a result of the insert 42 being taken out of engagement with the end face 43, the finger 41 is no longer urged towards the finger 40 by the reaction between the insert 42 and the end face 43 of the angled part 32 and thus the fingers 40 and 41 are allowed to spring apart and grip of the eye member 39 upon the pivot 38 is reduced.

It will be appreciated that, as with the embodiment of FIGS. 1 to 3, the pivot 38 rotates relative to the eye member 39 during the rotation of the window sash and the eye member is caused to engage the pivot during the initial opening of the window with reduced friction compared with the friction experienced when the window is opened beyond the initial opening position due to the eye member being clamped more firmly upon the pivot 38 and causing an increase in the friction.

Each of the embodiments described provides a window that is initially comparatively easy to open to a limited extent, while the friction between the pivot and the eye member during the remainder of the rotation of the window is such that accidental rotational movement of the window beyond the initial limited extent is rendered less likely. The arrangement of FIGS. 4 to 6 has the advantage of the first embodiment described that automatic adjustment for wear of the pivot and eye member is provided by the fact that the edge 43 acts upon the insert 42 with a sliding action.

Although particular embodiments of the invention have been described it will be appreciated that variations and modifications can be made within the scope of the invention.

For example, although in the particular embodiments described the circumference of an eye in an eye member through which a pivot extends is made adjustable it would be possible to make the eye in an eye member of fixed circumference and to cause the circumference of a collar on a pivot to increase with the weight of the window. In such an arrangement the pivot is located on the jamb of the window surround by means of a base plate sliding in a mounting plate and the eye member is mounted so that it is rotatable with the sash.

I claim:

1. A hinge for use in a horizontally pivoted window assembly, said hinge having a pivot member, an eye member co-operable with the pivot member, and means responsive, when the pivot and eye members are assembled, to the weight of a window acting on either of said members to increase the friction therebetween after an initial opening movement of the hinge.

2. A hinge as claimed in claim 1, including a mounting member on which the eye member is vertically slidable with respect thereto and said friction increasing means support the eye and pivot members on the mounting member after said initial opening movement.

3. A hinge as claimed in claim 2, wherein means are provided for slidably raising the eye and pivot members relative to the mounting member to reduce the friction between the eye and pivot members during said initial opening movement.

4. A hinge as claimed in claim 3, wherein the means for raising the eye and pivot members comprises co-operating parts on or connected to the pivot member and the mounting member respectively, said co-operating parts acting to support the eye and pivot members on the mounting member in a closed position of the hinge.

5. A hinge as claimed in claim 2 wherein said friction increasing means comprises an element projecting from the mounting member, there being resilient means operable by the projecting element to cause the friction to increase between the eye and pivot members after said initial opening movement.

6. A hinge as claimed in claim 5, wherein the resilient means is incorporated in the eye member to cause the eye member to tighten upon the pivot member after said initial opening movement.

7. A hinge as claimed in claim 6, wherein the eye member has a slot opening into its eye to provide said resilient means and the slot is narrowed after said initial opening movement to reduce the circumference of the eye.

8. A hinge as claimed in claim 5, wherein the mounting and pivot members have parts of semi-circular shape projecting therefrom with the semi-circular parts being disposed on opposite sides respectively of the eye member and wherein the resilient means is incorporated in the eye member which has a part arranged to react with a surface on the projecting element to cause the eye member to tighten upon the pivot member after said initial opening movement.

9. A hinge as claimed in claim 8, wherein the eye member is located on the mounting member by means of a projection on the eye member engaging in a groove on the mounting member.

10. A hinge as claimed in claim 1, wherein the eye and pivot members or the mounting and pivot members are adapted to be connected to or mounted on different ones of a window surround and window sash.

* * * * *